US008186854B2

(12) United States Patent
Albou

(10) Patent No.: US 8,186,854 B2
(45) Date of Patent: May 29, 2012

(54) HEADLIGHT MODULE FOR MOTOR VEHICLE, REFLECTOR FOR SUCH A MODULE, AND HEADLIGHT EQUIPPED WITH THIS MODULE

(75) Inventor: Pierre Albou, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 11/055,492

(22) Filed: Feb. 10, 2005

(65) Prior Publication Data

US 2005/0180153 A1 Aug. 18, 2005

(30) Foreign Application Priority Data

Feb. 13, 2004 (FR) ..... 04 01489

(51) Int. Cl.
*F21V 7/04* (2006.01)

(52) U.S. Cl. ..... 362/307; 362/310; 362/296.01

(58) Field of Classification Search ..... 362/516, 362/520, 307–308, 296, 255–256, 518, 519, 362/341, 347, 350, 296.01, 296.02–296.1; 257/100, 520, 307–308; 313/512; 31/512
See application file for complete search history.

(56) References Cited

U.S. PATENT DOCUMENTS

| | | | | |
|---|---|---|---|---|
| 2,112,411 | A * | 3/1938 | Schaffner | 362/211 |
| 3,037,139 | A * | 5/1962 | Myers | 313/113 |
| 5,084,804 | A | 1/1992 | Schairer | |
| 6,132,072 | A * | 10/2000 | Turnbull et al. | 362/494 |
| 6,641,287 | B2 * | 11/2003 | Suehiro | 362/298 |
| 6,945,672 | B2 * | 9/2005 | Du et al. | 362/241 |
| 6,951,415 | B2 * | 10/2005 | Amano et al. | 362/520 |

FOREIGN PATENT DOCUMENTS

| | | |
|---|---|---|
| EP | 0364806 | 4/1990 |
| EP | 1077344 | 2/2001 |
| FR | 2841 966 | 1/2004 |
| JP | 2003-031007 | 1/2003 |
| JP | 2003-141910 | 5/2003 |

OTHER PUBLICATIONS

Microwave Antenna Theory and Design 73-78, 504-505 (Samuel Silver ed.) (1984).

* cited by examiner

*Primary Examiner* — Robert May
(74) *Attorney, Agent, or Firm* — Locke Lord LLP

(57) ABSTRACT

In a headlight module for a motor vehicle, a light source having a planar surface, is immersed in a volume of transparent material, which has a refractive index greater than 1. A reflector having a focus is disposed relative to the light source so that the focus of the reflector is at a point of the light source. Accordingly, light rays emitted by light source are refracted by the transparent volume and reflected by the reflector so that such light rays become parallel to a predetermined direction.

9 Claims, 2 Drawing Sheets

HEADLIGHT MODULE FOR MOTOR VEHICLE, REFLECTOR FOR SUCH A MODULE, AND HEADLIGHT EQUIPPED WITH THIS MODULE

FIELD OF THE INVENTION

The invention relates to a headlight module for a motor vehicle comprising a light source having a planar surface, immersed in a volume of transparent material having a refractive index greater than 1, and a reflector having a focus situated at a point of the source.

BACKGROUND OF THE INVENTION

The invention concerns more particularly, but not exclusively, such a module whose light source consists of a light emitting diode, hereinafter referred to by the abbreviation "LED", whose emitting surface is protected by a hemispherical volume, generally made from a transparent polymer.

The aim of the invention is in particular to provide a headlight module which makes it possible to obtain a light beam with a cut-off, or having a maximum amount of illumination offset vertically, with a reduced number of components, whilst keeping good light efficiency.

In particular, it is wished to obtain a beam with a cut-off, or with a low pseudo cut-off, for a main-beam function or for an additional DRL (daytime light), in particular with so-called "Luxeon" LEDs, of the Lambertian type. In such LEDs, the luminescent material forming the light source is situated in one plane.

It is also desirable for the module to have a longitudinal size which is as small as possible, in particular less than that of headlights comprising elliptical reflectors and lenses.

SUMMARY OF THE INVENTION

According to a first aspect of the invention, a headlight module of the type defined above is characterised in that the point of the light source situated at the focus of the reflector is chosen so that the light rays emitted by this point are diverted by refraction, leaving the transparent volume in order to pass into the air, and in that the reflector is constructed so that these diverted light rays, after reflection on the reflector, become substantially parallel to a predetermined direction.

According to another aspect, the headlight module of the type defined above comprises a light source immersed in a volume, of the type consisting of a volume of revolution or a hemispherical volume of transparent material. The point of the light source situated at the focus of the reflector is separate from the center of the hemispherical volume, and the reflector comprises/consists of a stigmatic surface, i.e., a surface exhibiting stigmatism, between the point of the source and a straight-line segment situated in front of or behind the surface of the reflector.

According to yet another aspect, the light source is immersed in a hemispherical volume of transparent material and the point of the light source situated at the focus of the reflector is separate from the centre of the hemispherical volume, the reflector being constructed so that, by substituting for the point of the light source a frosted point of the planar base of the hemispherical volume and illuminating this frosted point with a laser beam, there is obtained, with the optical system comprising the hemispherical volume and the reflector, a beam to infinity formed by a horizontal segment or by a point.

Preferably the light source is an LED (the English abbreviation for designating a light emitting diode) immersed in a hemispherical volume of transparent material having a planar base turned in the opposite direction to the reflection.

The focus of the reflector can be situated at a point adjacent to an edge of the light source so that a light beam with cut-off is obtained. With the focus situated at a point adjacent to the top (or front) edge of the light source, a beam with a cut-off above a horizontal line is obtained, in particular for a main-beam or DRL function (that is to say the light is situated above the cut-off in this case). With the focus situated in the point adjacent to the bottom (or rear) edge of the light source there is obtained a beam with a cut-off below a horizontal line (that is to say in this case the light is situated under the cut-off, as in the case of a dipped beam).

The wave surface of the light rays after reflection on the reflector is advantageously a cylindrical surface admitting an axis on which the reflected light rays bear.

The invention also relates to a reflector for such a module, with its surface defined such that light rays issuing from a point situated at the focus, and refracted whilst emerging from a volume of transparent material surrounding the focus, become after reflection parallel to a predetermined direction.

The invention also relates to a headlight for a motor vehicle comprising at least one module as defined above. The headlight can comprise several modules giving individually beams with different characteristics but producing a satisfactory overall beam.

The invention consists, apart from the provisions disclosed above, of a certain number of other provisions which will be dealt with more explicitly below with regard to example embodiments described with reference to the accompanying drawings, but which are in no way limiting. In these drawings:

DESCRIPTION OF THE PREFERRED EMBODIMENTS

Figure 1:
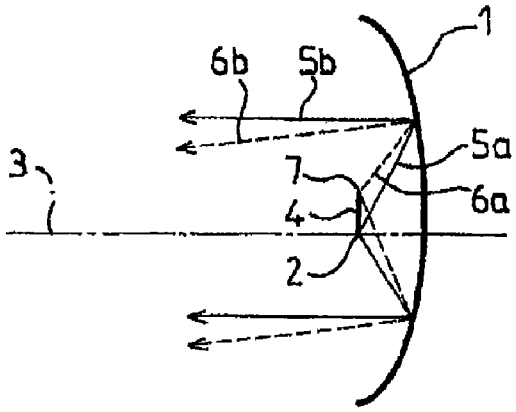
FIG. 1 is an explanatory diagram in vertical section of a reflector in the form of a paraboloid with a planar source orthogonal to the optical axis.

FIG. 1 is a diagram intended to facilitate understanding of the following description. In FIG. 1 a reflector 1, formed by a paraboloid, admits a focus 2 situated on the optical axis 3. A planar light source 4 is disposed in a plane orthogonal to the axis 3. A planar light source 4 is disposed in a plane orthogonal to the axis 3 and passing through the focus 2. The bottom or rear edge of the source 4 is situated at the focus 2. The focus 2 may also be situated at a point adjoining the top or front of the light source. The light rays such as 5*a* emitted by the bottom edge of the source 4 come from the focus and are reflected at 5*b* parallel to the optical axis. On the other hand, rays such as 6*a* coming from the top edge 7 of the source 4 are reflected at 6*b* in a direction inclined downwards with respect to the horizontal. The same applies for all the points of the source 4 situated above the focus 2.

The light beam thus obtained has a horizontal cut-off line and the area illuminated by the reflected rays such as 6*b* are situated below this cut-off line.

The surface of the paraboloid 1 is characterised optically by the fact that it transforms a spherical wave surface into a planar wave surface.

The source 4 of FIG. 1 is a planar theoretical light source emitting directly into the air in which the holder of the reflector 1 and source are immersed.

Figure 2:
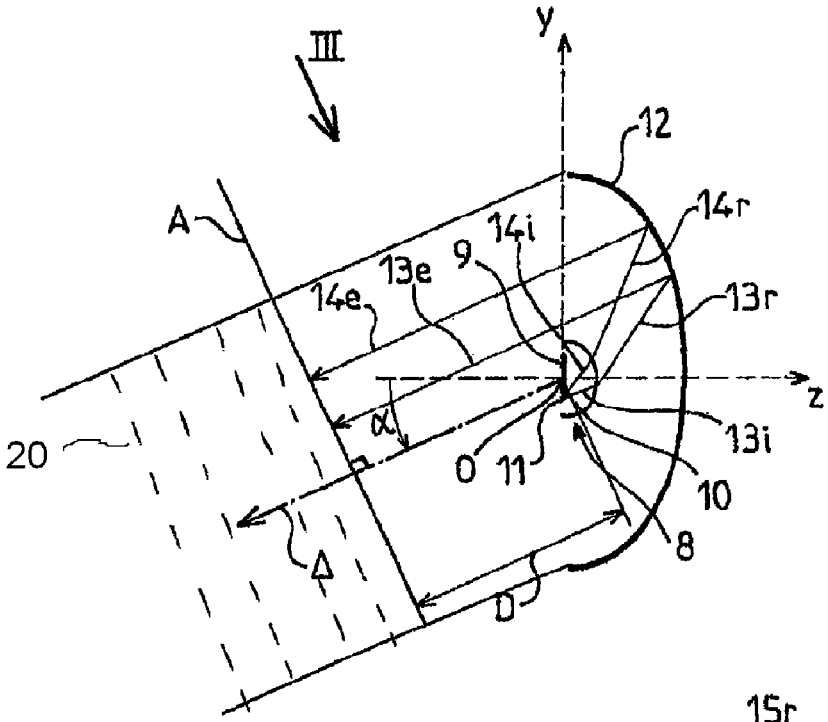
FIG. 2 is a diagram in section through a vertical plane of a headlight module according to the invention.

FIG. 2 illustrates a concrete embodiment of a planar light source formed by a high-luminance LED 8 which is composed of a thin planar layer of luminescent material 9, constituting the light source proper, and a volume 10 of transparent material covering and protecting the layer 9. Generally the volume 10 is of revolution, here hemispherical centered on the center O of the emitting layer 9, which may be square or rectangular. The base of the volume 10 is planar, formed by a large circle, and the layer 9 is immersed in the volume 10 at its planar base. The refractive index of the material of the volume 10 is greater than 1, that is to say greater than the refractive index of the air in which all the components are immersed. It is also possible to use a group of LEDs of this type, in particular aligned in an array.

The focus of a reflector 12, whose surface is different from that of a paraboloid, is situated at a point 11 of the source separated from the center O. This point 11 can be situated on the bottom edge of the layer 9 which, according to the representation in FIG. 2, is situated in a vertical plane. A light ray such as 13*i* emitted by the point 11 encounters the hemispherical surface of the volume 10 at an angle of incidence which is not zero and the ray 13*i* leaves the volume 10 into the air, being diverted by refraction in order to give the ray 13*r*. Another ray 14*i*, 14*r* issuing from the point 11 has been shown.

In the case where the focus of the reflector is situated at the centre O of the surface 9, the light rays coming from this point O are orthogonal to the hemispherical surface of the volume 10 (zero angle of incidence) and leave without being diverted. However, such an arrangement does not make it possible to obtain a light beam with cut-off.

According to the invention, the reflector 12 is constructed so that the refracted rays 13*r*, 14*r* become rays 13*e*, 14*e* parallel to a given direction Δ after reflection on the reflector 12. The direction Δ corresponds to the optical axis.

The surface of the reflector 12 is thus constructed in order to transform the point source 11, immersed in the transparent hemispherical volume 10, into a source with a cylindrical wave surface 20 admitting as the axis of the wave surface a straight line A (FIG. 2) orthogonal to the optical axis Δ.

The straight line A is situated a distance D from the centre O of the source. This distance D is a characteristic of the optical system, as is the angle α between the optical axis Δ and the horizontal direction OZ.

The point where the focus of the reflector is situated can be defined by three coordinates xf, yf, zf in an orthonormal reference frame where two axes are OY, OZ according to FIG. 2. The third axis OX, not shown, passes the point O and is perpendicular to the plane OYZ.

The family of the surfaces of reflectors such as 12 is thus characterised optically and mathematically.

The vector normal to the planar source 9 can be inclined to the horizontal.

Figure 3:
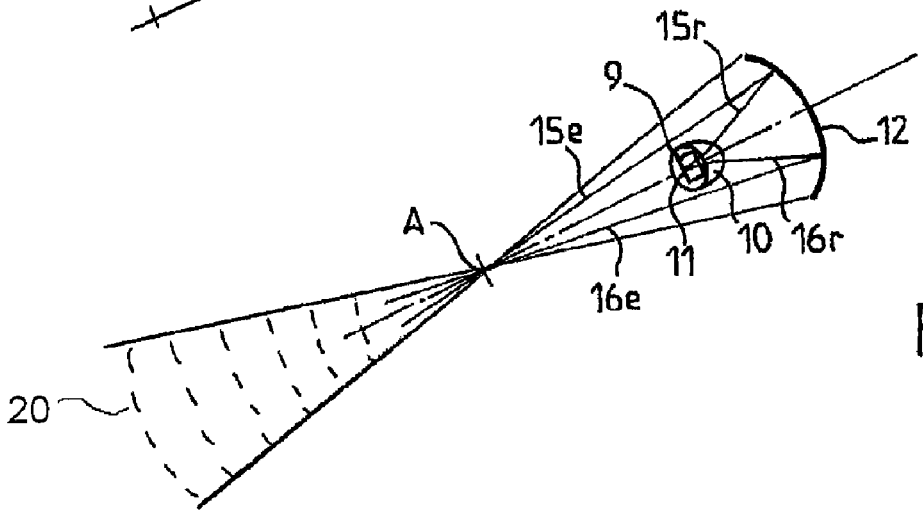
FIG. 3 is a partial schematic view, with cut away parts, in the direction of the arrow III in FIG. 2.

As can be seen in FIG. 3, rays diverted by refraction such as 15*r*, 16*r* coming from the point 11 situated an a plane different from that of FIG. 2 are reflected along radii 15*e*, 16*e* which intersect the axis A of the cylindrical wave surface 20 at a right angle.

The surface of the reflector 12 is stigmatic between (1) the point 11, which is immersed in a transparent sphere portion having a refractive index greater and not centered on this point 11, and (2) a segment of the straight line A that is situated in front of the surface of the reflector 12 in a direction of the propagation of the light.

In a variant, the straight line A could be situated behind the surface of the reflector 12, in which case the segment would be virtual; the section of the reflector 12 through a plane orthogonal to the straight line A would be more "open" than in the previous case, without going as far as a hyperbola (it would be a hyperbola only in the absence of the sphere portion 10).

By placing the focus of the reflector 12 on the bottom edge 11 of the source 9, a light beam with an upper cut-off, of the dipped or fog type, is produced.

To produce a beam with a lower cut-off below a horizontal line, in particular for a main beam function or a DRL function, the source 9 is disposed (see FIG. 4) so that the focus of the reflector is situated on the top, or front, edge 17 of the light source or in the vicinity of this edge. According to FIG. 4, which corresponds to a vertical section of a module for a main beam function, the plane of the source 9 is tilted forwards with respect to the vertical direction. The same applies to the reflector 12. A ray 18*r* coming from the point 17 is reflected in a ray 18*e* parallel to the horizontal optical axis and orthogonal to the axis A of the cylindrical wave surface 20. A ray such as 19*r* coming from the point of the source 9 situated lower than the point 17 is reflected in a ray 19*e* directed upwards and illuminating above the ray 18*e*. The cut-off is thus produced at the bottom of the beam.

Figure 4:
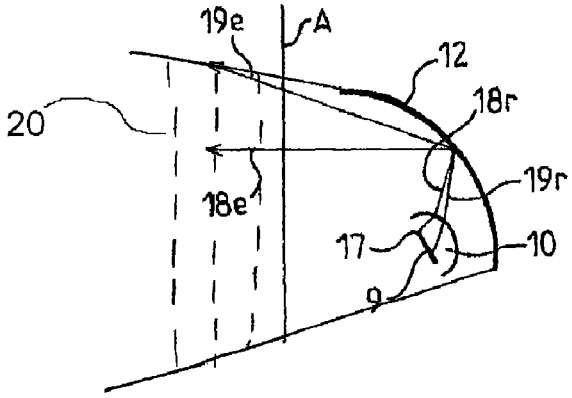
FIG. 4 is a schematic vertical section of a headlight for a main-beam function according to the invention.
Figure 5:
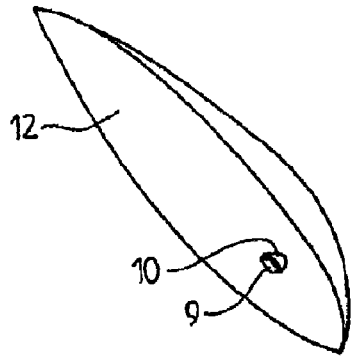
FIG. 5 is a schematic perspective view of a module according to FIG. 4.

FIG. 5 shows in perspective the headlight module of FIG. 4 with the reflector 12 whose top part is inclined forwards.

Figure 6:
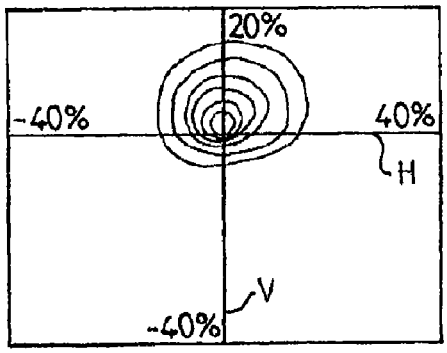
FIG. 6 illustrates a grating of isolux curves obtained on a screen orthogonal to the optical axis of the module of FIG. 4.

FIG. 6 is an example of a grating of insolux curves (that is to say with constant illumination) obtained, with a main-beam headlight according to FIG. 4, on a screen at a given distance, here 25 meters, from the headlight, orthogonal to the optical axis. The curves correspond to less and less strong illuminations from the center towards the outside. The straight line H corresponds to the intersection of the screen with the horizontal plane passing through the optical axis, and the straight line V corresponds to the intersection of the screen with the vertical plane passing through the optical axis. The right and left limits ±40% correspond to the intersections with the screen of light rays coming from the source and forming with the optical axis, in the horizontal plane, an angle whose tangent is ±0.4. The same explanation concerns the indicated limits 20% and −40% in the vertical plane.

From FIG. 6 it is clear that the "main" beam is essentially situated above the line H and is practically distributed equally on each side of the line V. The isolux corresponding to the maximum illumination is situated inside the grating and is substantially tangent to the line H, but being situated above this line.

The grating of isoluxes of FIG. 6 is obtained with a reflector 12 whose focus is situated practically on the top edge of the light source, with the parameters xf=0, yf=+0.5 mm, α=./4 and D=+1000 mm.

In order to shift the maximum amount of illumination downwards, it suffices to move the focus of the reflector 12 at a point of the source 9 situated lower than the top edge 17. If the focus of the reflector 12 is situated at the center of the source, the grating of isoluxes has a maximum centered on a crossing point of the lines H and V. In addition, the surface 12 becomes that of a paraboloid of revolution and the output beam is a parallel beam, the distance D becoming infinite.

It is thus possible to apportion the downward extent of the beam of the main-beam headlight.

Figure 7:
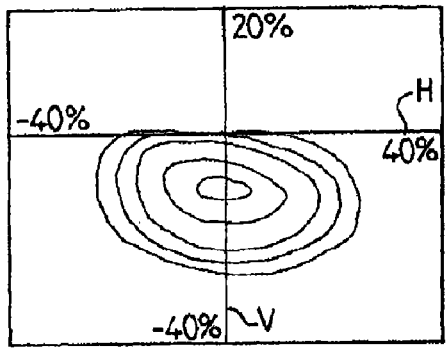
FIG. 7 is a grating of isolux curves obtained with a module giving a broad dipped beam.

FIG. 7 shows the isolux curves of a "broad" dipped beam with cut-off above the line H, obtained when the focus of the reflector 12 is situated on the bottom edge of the source 9. The beam of FIG. 7 is obtained with xf=0, yf=−0.5 mm, α=./4 and D=+75 mm. The distance D is relatively small, which makes it possible to spread the dipped beam horizontally.

Figure 8:
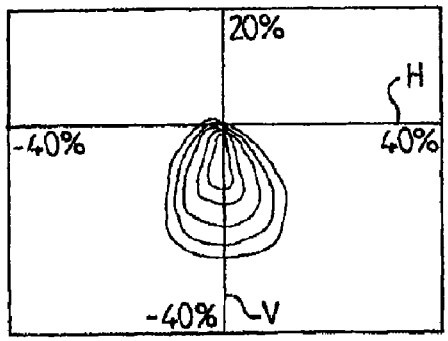
FIG. 8 shows, similarly to FIG. 7, the isoluxes of a focussed dipped beam.

FIG. 8 shows the isoluxes of a focussed dipped beam less spread horizontally than the beam of FIG. 7, but still situated essentially below the horizontal line H. The beam of FIG. 8 is obtained with xf=0, yf=−0.5 mm, α=−./4 and D=−1000 mm. The image of a point of the source is practically situated at infinity.

The beams of FIGS. 7 and 8 can also suit fog lights with horizontal cut-off.

A dipped headlight can give a beam comprising a horizontal cut-off on one side of the vertical line V and a cut-off along an inclined line starting from the crossing point of the lines V and H and rising on the side where the traffic travels (on the right for the majority of European countries). The angle of inclination is 15°.

To produce such a beam, it is possible to use several modules in accordance with the invention, some of which will have reflectors turned at 15° to the horizontal in order to provide the rising cut-off line.

A complete dipped, main beam or fog function will thus require several modules, each module comprising an LED. It is possible and desirable to vary the parameters such as D between the various modules for the same function.

The properties of a reflector 12 according to the invention can be checked in the following manner.

From knowledge of the LED used, it is possible to recover the corresponding hemispherical volume of this LED or reconstruct it from a transparent material having the same refractive index.

The bottom face, or planar base of the hemispherical volume, is frosted, i.e., rendered with a frostlike opaqueness, at a point corresponding to a vertex of the emitting source, or to the focus of the reflector if this is offset.

This hemispherical volume is next installed in the optical system with the frosted point placed at the focus, the base of the hemispherical volume being correctly oriented. The frosted point is illuminated with a laser beam and the beam reflected by the reflector 12 exits the headlight module in a manner consistent with any of the various light rays depicted throughout the drawings, which is observed at infinity given by the reflector.

With a reflector according to the invention, a horizontal segment is observed, which may amount to a point.

The search for the parameters, in particular D and yf, may be carried out by identification from a small number of points sensed on the surface of the base.

The headlight module according to the invention is particularly simple since it is composed essentially of a reflector and an LED. It makes it possible to obtain a beam with cut-off, without loss of light relating to the presence of a shield. Compared with a simple centred or defocused paraboloid, a minimisation of the maximum/low (or high) distance of the beam is obtained.

It should be noted that the volume of transparent material which covers the LED has been described essentially as hemispherical.

Other volumes could cover this LED, for example a conical volume of revolution.

What is claimed is:

1. A headlight module for a motor vehicle, comprising a light source having a planar surface, said light source immersed in a volume of transparent material having a refractive index greater than 1, and a reflector comprising a focus situated at a point of the light source separate from a center of the light source, wherein at least a portion of the transparent material is between the light source and the reflector, the light rays emitted by the light source are diverted upon exiting the transparent material, and the reflector is constructed to reflect and transform the diverted light rays emitted by the light source at the focus into reflected light rays having a cylindrical wave surface and forming a horizontal cut-off.

2. The headlight module of claim 1, wherein the focus of the reflector is situated at an upper edge of the light source, whereby a light beam with cut-off for a main beam or DRL function is obtained.

3. The headlight module of claim 1, wherein the focus of the reflector is situated in the vicinity of a bottom edge of the light source, whereby a light beam with cut-off for a dipped or fog-type beam is obtained.

4. A motor vehicle headlight module method for checking the properties of a reflector of the headlight module having a light source immersed in a hemispherical volume of transparent material having a refractive index greater than 1, and a reflector having a focus, a point of the light source being situated at the focus of the reflector away from a center of the hemispherical volume, the headlight method comprising:

installing a frosted point on a planar base of the hemispherical volume, illuminating the frosted point with a laser beam, obtaining a beam to infinity formed by the reflector; and observing a segment of the beam to infinity.

5. The method of claim 4, wherein the light source and the hemispherical volume of transparent material are components of an LED.

6. The method of claim 4, wherein installing the frosted point includes substituting the frosted point for the point of the light source.

7. The method of claim 4, wherein installing the frosted point includes placing the frosted point at the vertex of the light source.

8. The method of claim 4, wherein observing the segment of the beam includes at least one of determining the distance between an axis of a wave surface and the center of the light source, determining the angle between the optical axis and the horizontal direction, and determining at least one coordinate of the focus of the reflector in reference to a three-dimensional coordinate system that includes the center of the source as the origin of the coordinate system.

9. A headlight module for a motor vehicle, comprising a light source having a planar surface, said light source immersed in a volume of transparent material having a refractive index greater than 1, and a reflector comprising a focus situated at a point of the light source separate from a center of the light source, wherein at least a portion of the transparent material is between the light source and the reflector, the light rays emitted by the light source are diverted upon exiting the transparent material, and the reflector is constructed to reflect and transform the diverted light rays emitted from a point on the planar surface of the light source into reflected light rays having a cylindrical wave surface and forming a cut-off.

* * * * *